US008784180B2

(12) United States Patent
Stanek

(10) Patent No.: US 8,784,180 B2
(45) Date of Patent: Jul. 22, 2014

(54) SYSTEM AND METHOD FOR PLAY OF A NETWORK-BASED LOTTERY GAME

(75) Inventor: Edward J. Stanek, Des Moines, IA (US)

(73) Assignee: Scientific Games International, Inc., Newark, DE (US)

( * ) Notice: Subject to any disclaimer, the term of this patent is extended or adjusted under 35 U.S.C. 154(b) by 0 days.

(21) Appl. No.: 13/485,483

(22) Filed: May 31, 2012

(65) Prior Publication Data

US 2013/0324207 A1 Dec. 5, 2013

(51) Int. Cl.
*G07F 17/32* (2006.01)

(52) U.S. Cl.
USPC ..... 463/17; 463/16; 463/40; 463/41; 463/42

(58) Field of Classification Search
USPC ..... 463/16–17, 40–42
See application file for complete search history.

(56) References Cited

U.S. PATENT DOCUMENTS 5,042,809 A * 8/1991 Richardson ..... 463/18
5,324,035 A * 6/1994 Morris et al. ..... 463/42
5,327,485 A * 7/1994 Leaden ..... 463/17
5,377,975 A 1/1995 Clapper, Jr.
5,569,082 A * 10/1996 Kaye ..... 463/17
5,709,603 A 1/1998 Kaye
5,791,990 A * 8/1998 Schroeder et al. ..... 463/17
5,871,398 A * 2/1999 Schneier et al. ..... 463/16
6,024,640 A * 2/2000 Walker et al. ..... 463/17
6,322,446 B1 * 11/2001 Yacenda ..... 463/16
6,383,078 B1 5/2002 Yacenda
6,869,358 B2 3/2005 Yacenda
6,958,014 B1 * 10/2005 Luciano et al. ..... 463/17
6,991,541 B2 * 1/2006 Lind et al. ..... 463/17
7,008,317 B2 * 3/2006 Cote et al. ..... 463/16
7,008,318 B2 * 3/2006 Schneier et al. ..... 463/17
7,285,045 B2 * 10/2007 Schneier et al. ..... 463/17
7,303,468 B2 * 12/2007 Schneier et al. ..... 463/17
7,628,703 B2 * 12/2009 Wolf et al. ..... 463/42
7,887,404 B2 * 2/2011 Saffari et al. ..... 463/16
7,931,529 B2 4/2011 Yacenda
7,946,913 B2 5/2011 Yacenda
7,959,502 B2 * 6/2011 Kane et al. ..... 463/17
7,976,374 B2 * 7/2011 Kane et al. ..... 463/17

(Continued)

FOREIGN PATENT DOCUMENTS

WO WO 2011/051919 A1 5/2011

OTHER PUBLICATIONS

PCT Search Report and Written Opinion, Dec. 6, 2013.

*Primary Examiner* — Dmitry Suhol
*Assistant Examiner* — David Duffy
(74) *Attorney, Agent, or Firm* — Dority & Manning, P.A.

(57) ABSTRACT

A method and system for implementing a network-based lottery game includes providing lottery tickets to players, wherein each of the lottery tickets includes a code that allows the player to access an Internet site maintained by a server system for play of a lottery game via a network-enabled device. A game result file is randomly assigned to the player from a finite set of game result files maintained by the server system, wherein each game result file has a unique identifier and a predetermined game outcome. The predetermined game outcome is assigned to the player via the Internet-enabled device and, in the event of a winning game play, the unique identifier of the respective game result file is transmitted to the player for subsequent use in redeeming the game play.

15 Claims, 5 Drawing Sheets

(56) References Cited

U.S. PATENT DOCUMENTS

| | | | | |
|---|---|---|---|---|
| 8,033,905 | B2 * | 10/2011 | Irwin et al. | 463/17 |
| 8,083,583 | B2 * | 12/2011 | Bennett et al. | 463/21 |
| 8,308,162 | B2 * | 11/2012 | Rogers | 273/139 |
| 8,337,288 | B2 * | 12/2012 | Kane et al. | 463/17 |
| 8,408,986 | B2 * | 4/2013 | Irwin et al. | 463/17 |
| 2003/0045340 | A1 * | 3/2003 | Roberts | 463/17 |
| 2004/0204222 | A1 * | 10/2004 | Roberts | 463/17 |
| 2006/0160602 | A1 * | 7/2006 | Blythe et al. | 463/17 |
| 2006/0258433 | A1 * | 11/2006 | Finocchio et al. | 463/16 |
| 2008/0045299 | A1 | 2/2008 | Bennett, III et al. | |
| 2009/0023490 | A1 * | 1/2009 | Moshal et al. | 463/17 |
| 2009/0061992 | A1 | 3/2009 | Boykin et al. | |
| 2009/0227320 | A1 * | 9/2009 | McBride | 463/17 |
| 2011/0294585 | A1 * | 12/2011 | Penna et al. | 473/1 |
| 2012/0202571 | A1 * | 8/2012 | Stanek et al. | 463/17 |
| 2012/0202572 | A1 * | 8/2012 | Stanek et al. | 463/17 |
| 2012/0202573 | A1 * | 8/2012 | Stanek et al. | 463/17 |
| 2012/0202574 | A1 * | 8/2012 | Stanek et al. | 463/17 |

* cited by examiner

SYSTEM AND METHOD FOR PLAY OF A NETWORK-BASED LOTTERY GAME

FIELD OF THE INVENTION

The present invention relates generally to systems and methods of implementing lottery games, more particularly network-based lottery games wherein a player accesses a game site to play the lottery game.

BACKGROUND

The prospect of Internet-based lottery games sponsored by state (or other governmental agencies) is generating significant interest in the gaming industry. Internet-based gaming is, however, fraught with issues such as age and residency verification of players, collection of wager fees, redemption of winning plays, Internet security, and so forth. In addition, the sale of traditional online and instant lottery tickets is a significant source of income for authorized lottery retailers, who may perceive an increase in Internet lottery gaming as a threat to their business and role in traditional state lotteries.

Player perceptions and possible initial apprehension of Internet-based lotteries are also concerns. For example, the market in the United States alone for state-sponsored instant ("scratch-off") lottery tickets is estimated to be in the tens of billions of dollars. Whether or not the players of these conventional lottery tickets will readily accept and quickly transition to a purely network-based system is an open question. Even the loss of a relatively small percentage of players can have a significant economic impact.

Some initial endeavors into various aspects of Internet-based lotteries have been made. For example, GTECH Corporation of Providence, R.I., USA, offers a "Renaissance Program" in the state of Illinois wherein a General Purpose Reloadable (GPR) debit card is issued free of charge to identified players, who may then load money on the card (e.g., via credit or debit card) and use the card for Internet lottery game purchases. This program, however, effectively bypasses the traditional lottery retailer.

Other aspects of Internet-based lotteries are described, for example, in U.S. Pat. No. 6,277,026; U.S. Pat. No. 6,322,446; U.S. Pat. No. 6,869,358; U.S. Pat. No. 7,931,529; U.S. Pat. No. 6,383,078; U.S. Pat. No. 7,946,913.

U.S. Pat. No. 5,569,082 and the related U.S. Pat. No. 5,709,603 each describe a method and system for on-line play of a game wherein the player acquires a "destiny code" on a game medium (which may be paper). The destiny code stores the outcome of a particular game of chance, as well as other data that may assist in playing the game. The player may enter the destiny code on their home computer of other type of on-line service device to access and play the game via an on-line service system. After verification of the code, the predetermined outcome of the game is presented to the player via an entertaining and interactive game.

The present invention offers an Internet-based lottery game system and method that addresses some of the major concerns noted above.

SUMMARY

Objects and advantages of the invention will be set forth in part in the following description, or may be obvious from the description, or may be learned through practice of the invention.

In particular embodiments, a method or system are provided for implementing a network-based lottery game, such as an Internet-based game accessed via an Internet game site. Lottery tickets are first provided to players, for example at an authorized point-of-sale retail establishment. Each lottery ticket includes a code that allows the player to access a game site maintained by a server system via a communication network, such as the Internet, for play of the lottery game via a network-enabled device, such as a personal computer, smart phone, PDA, or the like. For play of the game, a game result file is assigned to the player from a finite set of game result files that were provided to and maintained by the server system. For example, the set of game result files may include 250,000 files or 1,000,000 files, or some other defined number. Each of the game result files has a unique identifier and a predetermined game outcome. The assignment of the game result file to the player from the set of game result files is randomly determined. During the course of the game play, the predetermined game outcome is displayed to the player, for example via their network-enabled device and, in the event of a winning game play, the unique identifier of the respective game result file is transmitted to the player from the server system for subsequent use in redeeming the game play.

In a particular embodiment, an identical set of the game result files is provided to a host computer system maintained by a gaming authority, such as a state, or other governmental gaming authority or its agent. For redemption of winning game plays, the unique identifier provided to the player is transmitted to and used by the host computer system to retrieve the corresponding game result file from the set of game result files maintained by the gaming authority host computer system. This retrieved game result file is essentially identical to the game result file initially assigned to the game play by the network server system and is used to confirm the player's redemption claim without the necessity of the gaming authority host computer system communicating with the server system that initially assigned the game result file and controlled play of the game via the game site. The verified game result files may be effectively eliminated from the set of game result files maintained by the gaming authority host computer. It should be appreciated that this may simply involve deleting the file or otherwise rendering the game result file incapable of being claimed again without physically erasing/removing the file from memory.

The unique identifier for a winning game result file may be transmitted to the player in various ways. For example, the identifier may be provided to the player in the form of a code that is subsequently transmitted to the gaming authority host computer system. This code may be, for example, an alphanumeric code, bar code, QR code or any other type of encrypted format. The code may be provided for printing by the player, wherein the printed document is subsequently presented by the player for scanning or entry by a redemption device (e.g., a terminal) in communication with the gaming authority host computer system. In an alternate embodiment, the code may be presented in electronic form to the player (e.g., a barcode or QR code transmitted to the player's smart phone) for subsequent scanning by a redemption device in communication with the gaming authority host computer system.

The game system and method may require that the code is transmitted to the gaming authority host computer system via a lottery terminal at an authorized retail establishment, which may also be authorized to sell the lottery game tickets. This lottery terminal may be the same device configured for issuing the original lottery tickets, or a separate device specifically configured to scan or otherwise enter the code presented by the player for redemption of the winning game play.

The lottery ticket provided to the player, for example at a retail establishment, may include any other type of game component that is conducted independently of the website-based game. For example, the ticket may also be an online ticket that enters the player into a subsequent draw game, such as the well-known POWERBALL or MEGA-MILLIONS draw games. In an alternate embodiment, the lottery ticket may include an instant-win game component (e.g., a scratch-off game) that may be played by the player independent of the network-based lottery game.

Assignment of the game result files by the server system may be done in various random ways. For example, the set of game result files maintained by the server system may be randomly shuffled prior to assigning the first one of the game result files to a player, with the subsequent files being assigned sequentially. Alternatively, the set of game result files may be periodically shuffled, including prior to every assignment of one of the game result files to a player. In still another embodiment, the game result file assigned to a player may be randomly selected from the set of game result files maintained by the server system.

In a certain embodiment, the game result files assigned by the server system to players are subsequently effectively eliminated from the set of game result files maintained by the server system to prevent any possibility that the file is reassigned. This includes any manner of deleting or otherwise rendering the game result file incapable of being subsequently reassigned without physically erasing/removing the file from memory.

The network-based game may be variously implemented. In one embodiment, the game result files include instruction files for implementing play of an interactive game by the player on their Internet-enabled device prior to the predetermined outcome of the game play being presented to the player. The game may be played entirely via the game site or, in an alternate embodiment, instruction files may be downloaded to the player's network-enabled device so that the player can play the interactive game in stages or repeat play of the interactive game without further communication with the server system.

With still another embodiment, a record may be maintained by the server system of each code presented by a player for play of the network-based lottery game, wherein the code presented by a player is checked against the record of previously presented codes to verify that the code has not been previously played. Similarly, a record may be maintained by the server system of all codes assigned to the set of lottery tickets, wherein the code presented by a player for play of the network-based lottery game is checked against the record of assigned codes to verify that the presented code is authentic.

Additional aspects of the methodology and system are discussed in greater detail below by reference to particular non-limiting embodiments illustrated in the drawing.

DETAILED DESCRIPTION

Figure 1:
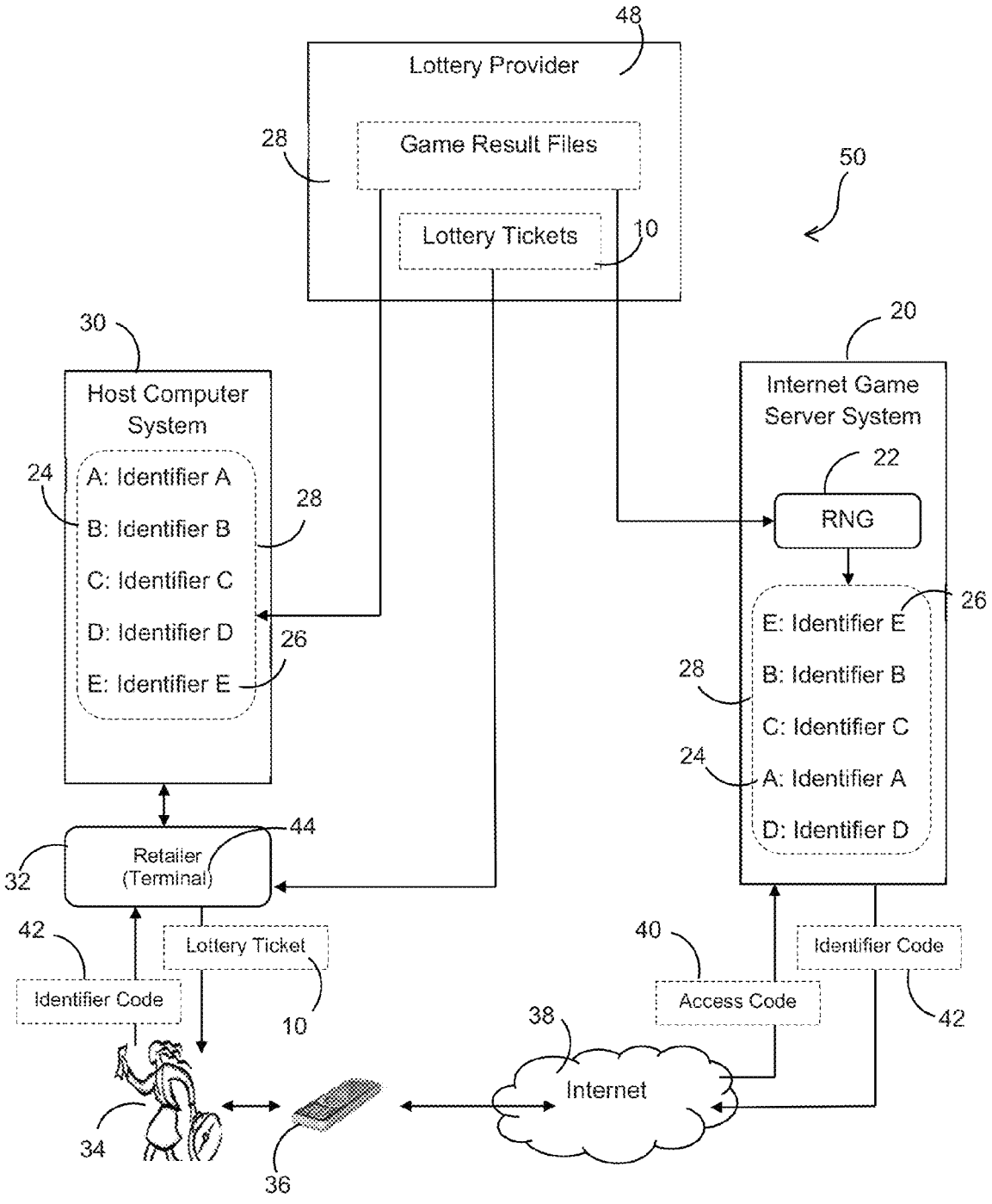
FIG. 1 is a diagrammatic view of a system and methodology in accordance with aspects of the invention.

Reference will now be made in detail to embodiments of the inventive methods and systems, one or more examples of which are illustrated in the drawings. Each embodiment is presented by way of explanation of the invention, and not as a limitation of the invention. For example, features illustrated or described as part of one embodiment may be used with another embodiment to yield still a further embodiment. It is intended that the present invention include these and other modifications and variations as come within the scope and spirit of the invention.

FIG. 1 depicts certain conceptual principles of a system 50 for implementing a network-based lottery game wherein players are given access to a network game site for play of a lottery game having a predetermined outcome. It should be understood that the present invention system and associated methods are not limited by any particular type of game, and the term "lottery game" is used herein to denote any type of probability-based game offered to eligible persons, such as a draw game, instant-win game, and the like. The games may be presented to players purely for entertainment value at no cost to the player. Prizes may be awarded to a player for a winning game play, which may include a cash award. In other embodiments, the player places a wager amount for play of the lottery game in the hopes of winning a cash award or other type of prize.

In the embodiment depicted in FIG. 1, the game may be administered by a lottery provider 48, which is the entity that provides lottery tickets 10 to a gaming authority or administrator. In an alternate embodiment, the lottery provider 48 and gaming authority may be the same entity. The gaming authority may be, for example, a state or other regional governmental entity that provides lottery games to eligible players via authorized retailers or retail establishments 32. In the United States, for example, the gaming authority may be a state or affiliation of states that offers lottery games to their residents via the sale of lottery tickets at authorized retail establishments.

The gaming authority typically utilizes a central host computer system 30 in communication with the various retail establishments 32, particularly the lottery terminals 44 maintained at the retail establishments (also referred to as point-of-sale terminals). Typically, a vast number of such terminals 44 are operatively coupled to the central host computer system 30 via any suitable communications network, which may be, for example, the Internet, a wide area network (WAN), a local area network (LAN), a telephone system, and so forth. In a particular embodiment, the lottery network may include a state lottery system operating within an individual state or region of states, wherein the lottery terminals 44 are interconnected to the game administrator and host computer 30 directly or through an intermediary network for tracking, administration, and coordination of the state lottery system, including control of issued tickets, prizes, amounts waged, and so forth. It should be readily appreciated that the present invention encompasses any suitable communications architecture that provides the point-of-sale lottery terminals 44 with the ability to communicate and interact with the game administrator's central host computer system 30.

The point-of-sale terminals 44 may include any conventional feature known to those skilled in the art related to lottery terminals. The terminal 44 includes features and functionality to allow a player or retail clerk to enter the information required to participate in the lottery game. An exemplary terminal 44 includes a housing, one or more input devices, which may be a control panel having input keys, a display, a value input device such as a card reader, a play slip or ticket reader, and a ticket printer. The play slip reader is typically configured to read user selection marks, bar codes, magnetically stored information, or any other desired input information. Control panel input keys allow the player or retail clerk to select the game to be played, input the value to be wagered, manually enter selected lottery characters, and input any other information necessary to play the lottery game. The terminal preferably includes a display which may be an LCD, a CRT, or touch-screen capable of receiving and displaying information related to the game. The value input device may include any device that can accept value or a wager from a customer, such as a card reader or an optical currency collector. The value input device may be integrated with external devices, such as a cash register or other retail terminals, to exchange information necessary to receive and record the wagering transaction. The lottery ticket printer may be used to print or otherwise encode lottery tickets with information selected or required to play the lottery game. The printer may provide lottery tickets that reflect a player's selection, or complete lottery slips if the selection was generated automatically by the terminal.

The host computer system 30 may be a single networked computer, or a series of interconnected computers having access to the lottery system or network via any suitable networking system. Generally, such computer systems 30 are configured to manage, execute, and control the individual lottery terminals 14 and the routines used to play various lottery games, or track information related to the sale and distribution of pre-printed instant lottery tickets, such as scratch-off lottery tickets. The host computer 30 may include memory for storing lottery programs, files, and routines, a microprocessor for executing stored routines, random access memory (RAM), and an input/output (I/O) bus. In addition, the host computer 30 may be in communication with any manner of external device, including external databases. Such databases may provide a data repository for the storage and correlation of information gathered from the individual lottery terminals 44 relating to the individual terminals, such as terminal specific information like the machine ID, sales establishment, location, and ticket-specific information. It should be readily appreciated that the host computer 30 may encompass any configuration of hardware and software applications necessary to manage, execute, and control administration of the lottery game.

Still referring to the embodiment of FIG. 1, a game server system 20 is provided with any suitable hardware and software configuration for enabling play of network-based lottery games whereby players 34 access a game site (e.g., an Internet site) maintained by the game server system 20 via a network-enabled device 36 and communications network 38. The network-enabled device may be, for example, a personal computer, smart phone, personal digital assistant (PDA), or other intelligent communications device. The communication network may be, for example, the Internet, a wide area network (WAN), a local area network (LAN), a telephone system, and so forth. In a particular embodiment, the game server system 20 maintains an Internet game site accessible to players via the Internet 38.

It should be appreciated that the present game system and method are not limited to an Internet implementation, but encompass any system configuration wherein players are provided access to a game site via a communications network. This network may be a WAN or LAN provided, for example, solely to patrons of certain establishment, such as a casino or other type of gaming house.

Figure 2B:
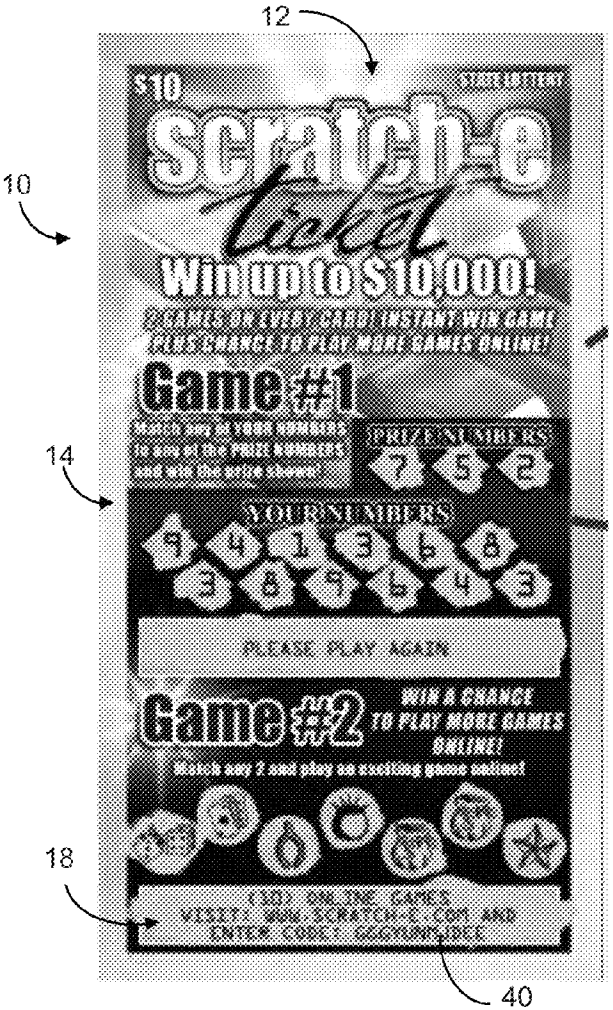
FIGS. 2A and 2B are front views of an embodiment of a lottery ticket that may be used with the system and method of the present invention.
Figure 2A:
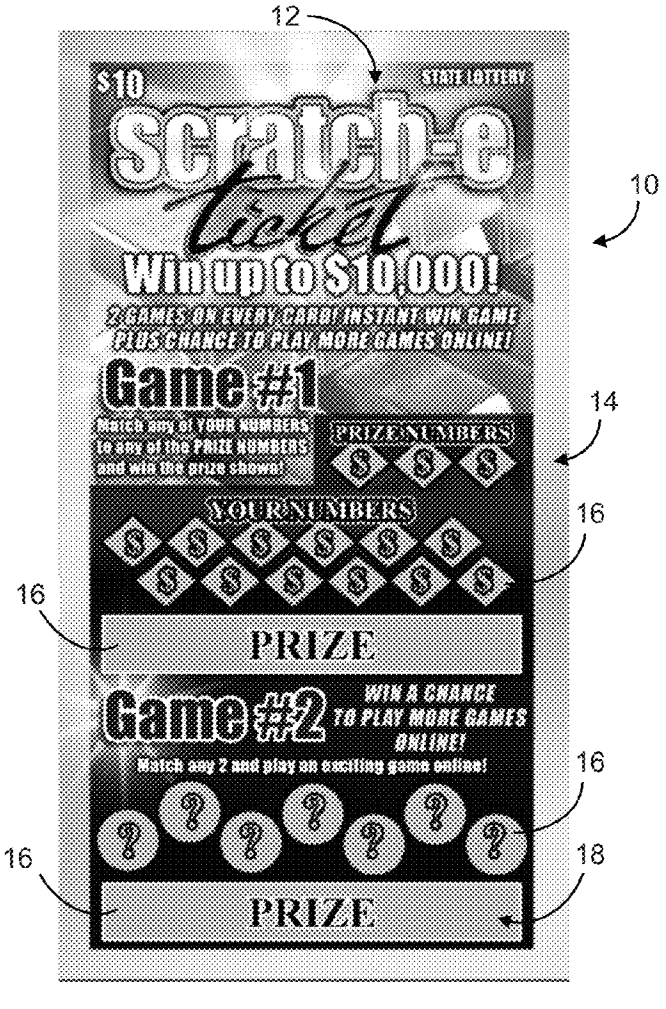

FIGS. 2A and 2B represent an embodiment of a lottery ticket 10 that may be used to initiate the game. This particular embodiment of a ticket 10 includes any manner of indicia 12 that advertises, describes, illustrates, or in any way presents aspects of the particular lottery game to a purchaser. The lottery ticket 10 may include a game component that is completely independent of the network-based game. For example, referring to FIGS. 2A and 2B, the lottery ticket 10 implements an instant-win game wherein players play a scratch-off game in the game area 14. As is well known, typical scratch-off games include game indicia and prize award indicia that is covered by a removable coating 16. The player removes the coating 16 to reveal whether or not the ticket represents a win or loss. It should be appreciated that the present invention is not limited by any particular type of additional game component implemented by the ticket, and that the scratch-off game depicted in FIGS. 2A and 2B is for representative purposes only.

In an alternate embodiment, the lottery ticket 10 may also be an entry into a draw game, such as POWERBALL or MEGAMILLIONS, wherein indicia selected by the player (or randomly selected for the player) is presented on the ticket and compared to indicia randomly generated in a subsequent draw event to determine if the ticket is a winner.

In still a further embodiment, the Internet game may be a continuation of a lottery game component initially provided to the player by the retailer. For example, a conventional crossword lottery game or a Bingo game might have an Internet component that provides additional or bonus letters or numbers, respectively, that complete a win in the base game or enhance the prize in the base game. The Internet component may convert a non-winning game component implemented on a lottery ticket into a winning game Still referring to FIGS. 2A and 2B, the lottery ticket 10 includes an access code area 18 wherein the player is presented with a code 40 (FIG. 2B) that allows the player to access a game site maintained by a server system 20 (FIG. 1) via, for example, a network-enabled device 36 (FIG. 1). In the embodiment of FIGS. 2A and 2B, the code 40 in the access code area 18 is covered by a scratch-off coating 16 and is provided as a feature of a "Game #2" component of the lottery ticket 10 wherein the player is presented with the code 40 as a "prize" for matching certain indicia in the Game #2. This "prize" may be purely for illusion purposes, with each lottery ticket 10 providing a code 40 regardless of an actual win or loss in the game. For example, a win may be a guaranteed event in the Game #2. However, in an alternative embodiment, the access code 40 may be provided only if the player satisfies some actual "win" criteria in a game formatted on the ticket 10. In still another embodiment, the code 40 may simply be provided on the ticket 10 without any type of qualification.

Figure 3:
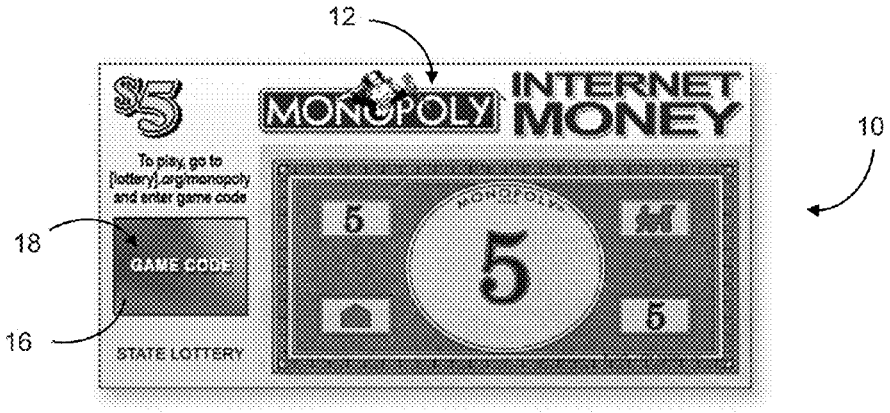
FIG. 3 is a front view of another embodiment of a lottery ticket that may be used with the system and method of the present invention.

FIG. 3 depicts another embodiment of a lottery ticket 10 having any manner of indicia 12 for advertising or otherwise describing or illustrating aspects of the network-based lottery game to be played by a player using the access code provided in the access code area 18 of the ticket (beneath the scratch-off coating 16). With the embodiment of the ticket 10 in FIG. 3, the ticket is simply a means to present the access code to the player, and does not incorporate or otherwise involve any other type of lottery game component. With this embodiment, the purchaser pays a wager amount (e.g. $5) for the access code that enables the player to play a MONOPOLY-themed lottery game via an Internet game site.

Figure 4:
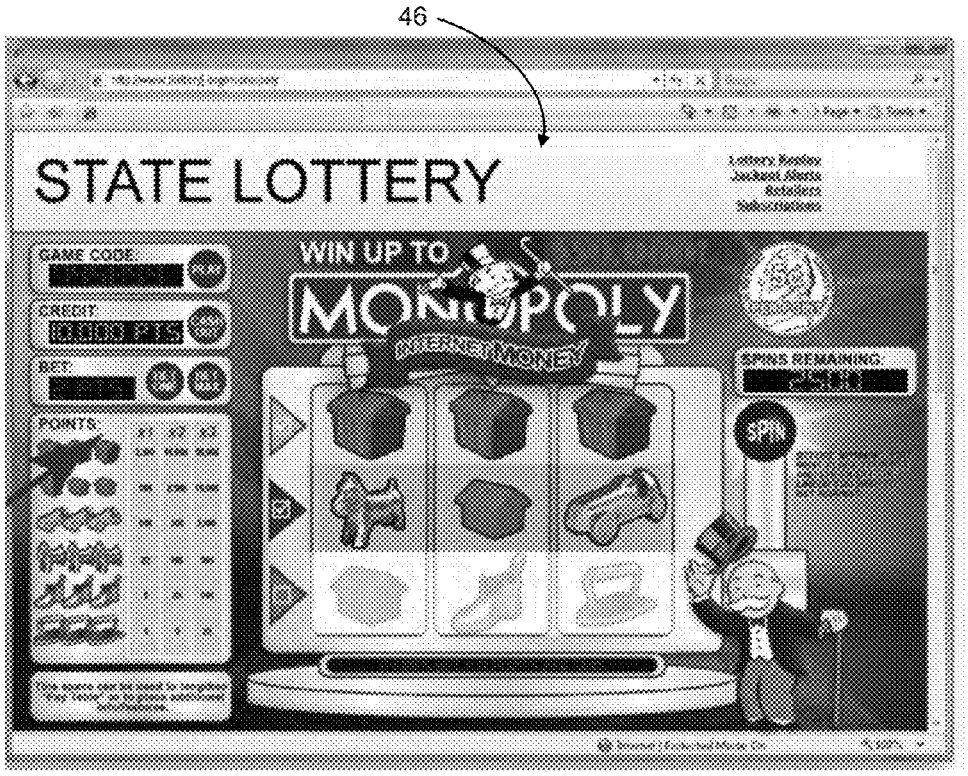
FIG. 4 is an Internet screen shot depicting an interactive game that may be played with the method and system of the present invention.

FIG. 4 is a screen shot from an Internet site wherein the network-based game is played by a player, for example via a personal computer, smart phone, or other internet-enabled device. The type of game depicted in FIG. 4 may be an interactive game which requires the player to perform certain acts or functions via the game site before the predetermined outcome of the game play is presented to the player. For example, the interactive event may be a simulated slot-machine spin, poker hand, or other simulated game of chance. It should be appreciated that the type of interactive game depicted in FIG. 4 is for illustrative purposes only, and that the present system and method are not limited to any particular type of game that is enabled and played by the player 34 via the game site.

In an alternative embodiment, the player may be presented with the predetermined outcome of the game immediately after accessing the game site without the necessity of playing any type of interactive game.

Referring again to FIG. 1, each of the game server system 20 and host computer system 30 are provided with the functionally identical set 28 of game result files 24. These sets 28 may be provided, for example, from the lottery provider 48 that also supplies the lottery tickets 10 to the gaming authority for sale and distribution via the authorized retailers 32. The game server system 20 may be maintained by the lottery provider 48, or some other independent entity. The set 28 of game result files 24 includes a defined number of individual game results. For illustrative purposes only, FIG. 1 depicts five game result files 24 (files A through E). It should be appreciated that the actual number of game result files 24 within a given set 28 may be quite large. For example, a set 28 may include 250,000 or 1,000,000 game result files 24, or more. The only requirement is that the set 28 has a defined number of the game result files 24.

Each game result file 24 includes a unique identifier 26 such that each file 24 may be distinguished from any other file 24 within the set 28. This identifier 26 may be in any suitable format for generating, processing, and storing by the host computer system 30 and game server system 20.

A set of the lottery tickets 10 is provided to the gaming authority for sale or other distribution to eligible players. In a certain embodiment, the number of tickets 10 within the set corresponds to the number of game result files 24 within the set 28 of game result files provided to the host computer system 30 and game server system 20. In other words, if the set 28 of game result file includes one million files 24, then a set of the lottery tickets 10 is also provided having the same number of lottery tickets. As described above, each of the lottery tickets 10 includes a code 40 that allows the player 34 to access a game site maintained by the game server system 20 via a communications network 38, such as the Internet, with any suitable network-enabled device 36. In one embodiment, a unique access code 40 is provided on each lottery ticket such that no two tickets within a set of the lottery tickets 10 includes the same access code. However, in an alternative embodiment, the access code 40 may be a generic code that is provided on multiple ones of the lottery tickets 10. Thus, with this embodiment, the number of lottery tickets 10 generated for sale to players need not correspond to the number of game result files 24.

It should be appreciated that the access code 40 is not linked to any particular game result file 24 until the player 34 actually accesses the game site to initiate play of the network-based game.

Still referring to FIG. 1, the set 28 of game result files 24 associated with the game server system 20 is depicted in random order for purposes of illustrating the random nature of assigning an individual game result file 24 to any particular game initiated by a player 34. This "random" association may be done in various ways. For example, the game server system 20 may be associated with any manner of random number generator 22 that serves to essentially randomly shuffle the game result files 24 within the set 28 maintained by the game server system 20. This shuffling may be done, for example, at the initial loading of the game result files 24, wherein the game result files 24 are then sequentially assigned to respective game play. In an alternative embodiment, the game result files 24 may be periodically shuffled during the course of the game as a function of time, or other triggering event. For example, the game result files 24 may be shuffled at every 1,000 plays of games, or based on a time event, such as on every hour, and so forth. In still another embodiment, the game result files 24 may be shuffled at each assignment of a game result file to a respective game play. It should be appreciated that this "shuffling" concept also includes simple random selection of a game result file 24 from the set 28.

Figure 5A:
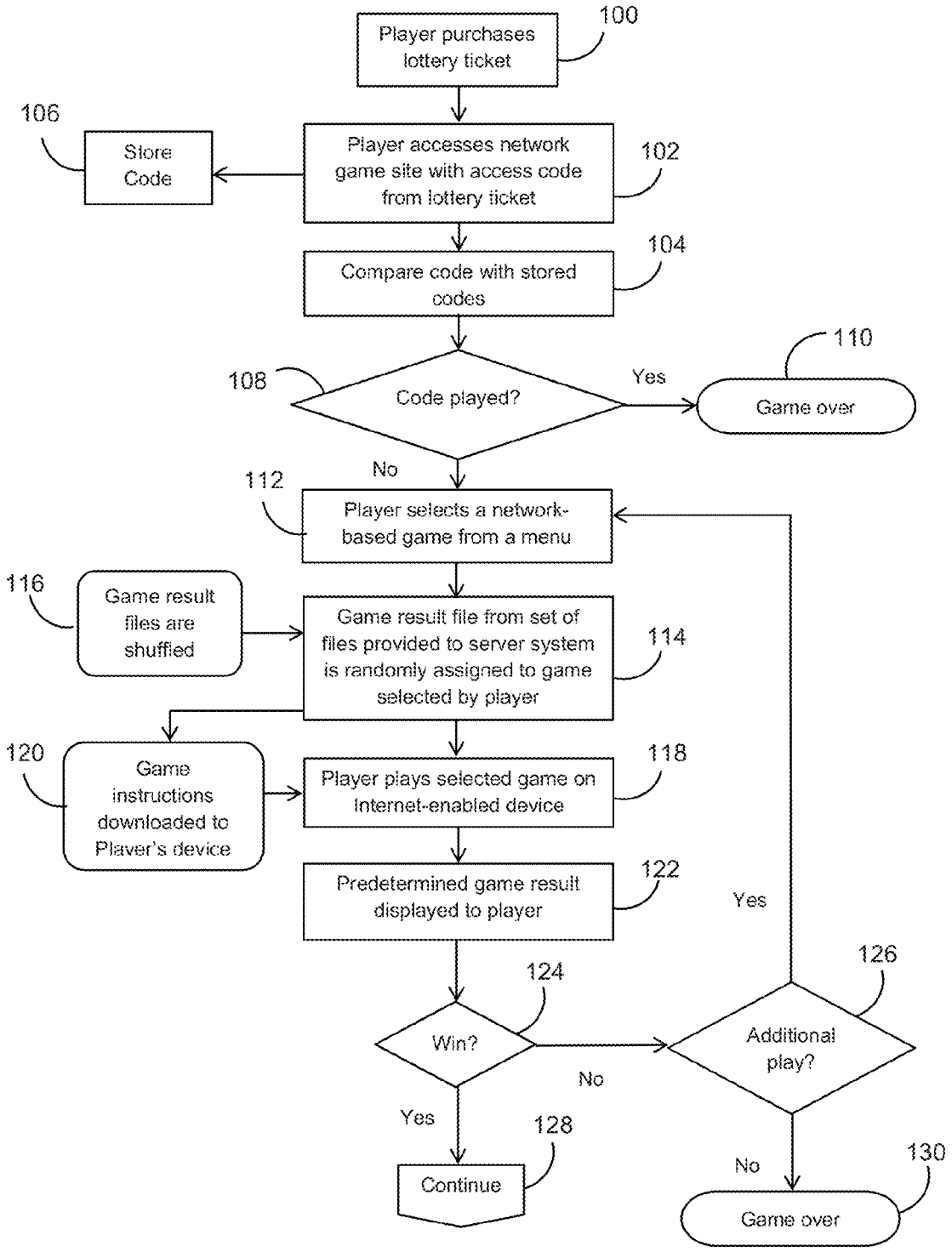
FIGS. 5A and 5B are block flow diagrams of exemplary methods in accordance with aspects of the invention.
Figure 5B:
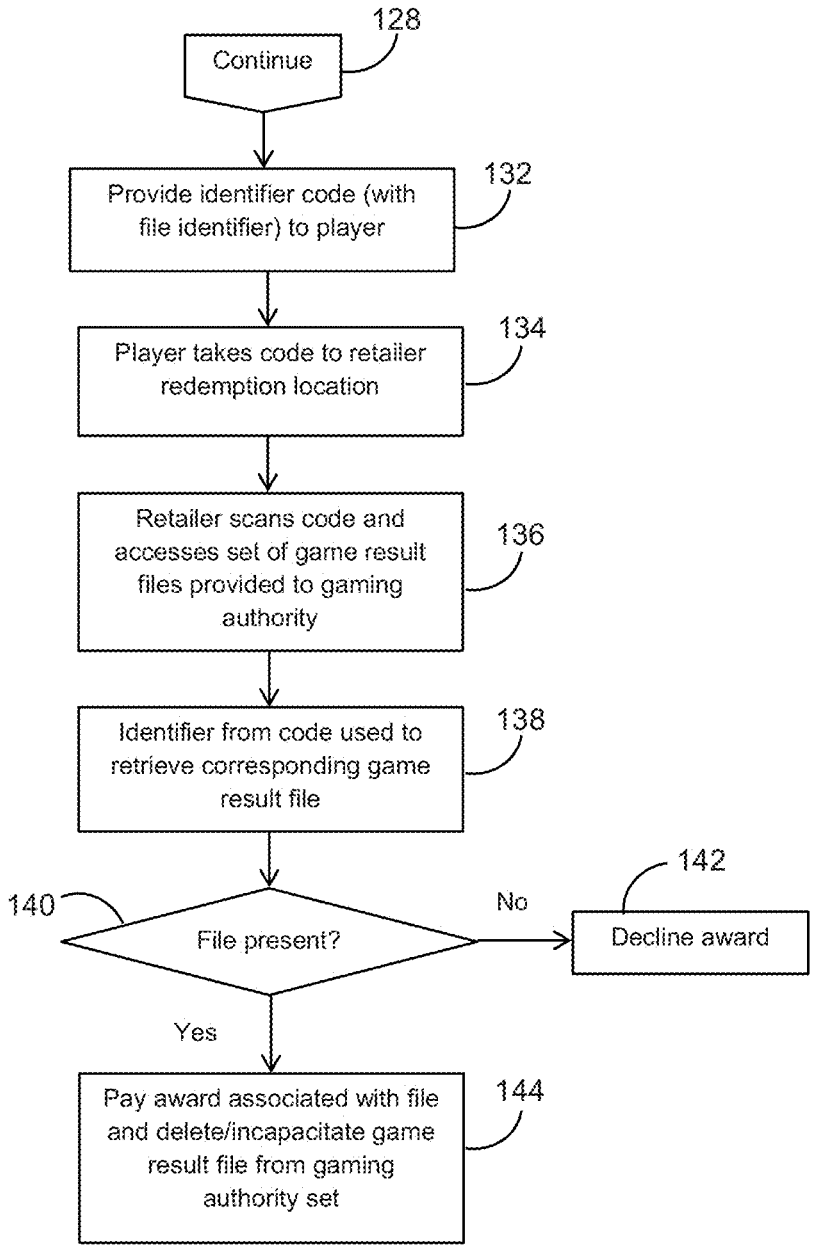

Referring to FIGS. 5A and 5B, various aspects of a gaming methodology associated with the system 50 depicted in FIG. 1 are described. At step 100, a player 34 purchases a lottery ticket 10 from, for example, a retailer 32 authorized by the gaming authority. At step 102, at a time of their choosing (which may have limits established by the gaming authority), the player 34 accesses a game site maintained by the game server system 20 using the access code 40 provided on the lottery ticket 10. As described above, the player 34 may use any manner of suitable network-based communications device to access the game site via a communications network 38, such as the internet.

In the event that each access code 40 is unique to a respective lottery ticket 10, steps 104 and 106 may be performed by the game server system 20. At step 104, the code entered by the player is compared with a file of previously stored codes to determine if the code has already been played. At step 106, the code entered by the player is stored in the file by the game server system 20. If the code has been previously played, the game is terminated at step 110 and the player is provided with an appropriate message via the Internet enabled device 36 indicating that the game was previously played.

In particular embodiments, the player may be provided the option of choosing any one of a number of different types of games to associate with their lottery ticket 10 via the game site. For example, the player may be given the option to play a poker-themed game, horse race-themed game, sports-themed game, and so forth. With this embodiment, at step 112, the player selects the particular game they desire to play from a menu of games presented to the player via the game site. In this particular embodiment, regardless of the game selected by the player, the outcome of the game is not influenced by the player's selection, but is determined by the game result file assigned by the game server system 20 to the player's selection.

At step 114, one of the game result files 24 in the set 28 of files maintained by the game server system 20 is randomly assigned to the game selected by the player. This "random" assignment may be done in any suitable manner, as discussed above. For example, the game result files may be shuffled at step 116 for each and every assignment of a game result file 24.

At step 118, the player "plays" the selected game on their Internet-enabled device 36 if the game is presented as an interactive type of game for entertainment purposes. This interactive participation by the player will not change the game outcome.

In an alternate embodiment depicted at step 120, game instruction files are downloaded to the player's Internet-enabled device 36, whereby the player has the option to play the game at some future time on their device 36 prior to the predetermined outcome of the game being presented to the player in the course of the game. This feature may be desirable to players in that they can play the game at their leisure, or may repeat play of the game at any given time for their own entertainment.

It should be appreciated that the game outcome associated with an individual game result file 24 is predetermined and that the player cannot influence the outcome of the game even though the game may be presented in an interactive format. In this manner, the gaming authority and lottery provider can closely control and maintain the winning odds probabilities and design payout for the overall lottery game. For example, if the game is designed with a win probability of 1 in 4, then 1 out of every 4 of the game result files 24 in the set 28 of files will produce a winning game play. The prize award for the respective winning game plays is also predetermined and associated with the game result file 24 so that the lottery can achieve its desired payout percentage based on the overall number of lottery tickets 10 sold during the course of the game.

At step 122, the predetermined game result is displayed to the player, for example via their Internet enabled device 36. The player is informed whether or not the game play is a winning event and the amount or value of any associated prize award.

In the event that the game play is a non-winning event at step 124, the player is queried as to whether or not they desire to play another game at step 126 if the initial lottery ticket 10 authorized multiple game plays. For example, the code 40 associated with the initial lottery ticket 10 may have authorized four different network-based game plays. Alternatively, the code 40 may have authorized only one game play, wherein the game is terminated at step 130.

In the event that the game play was a winning play, then the process continues at step 128.

Referring to FIG. 5B, in the event of a winning game play, a suitable form of the unique identifier 26 associated with the respective game result file is effectively provided to the player at step 132. This may be accomplished in various ways. For example, referring to FIG. 1, a game identifier code 42 may be transmitted to the player 34 from the game server system 20, wherein this identifier code 42 includes the unique file identifier 26 associated with the winning game result file 24. This identifier code 42 may be provided in encrypted form to the player, for example, as an alphanumeric code, bar code, QR code, and so forth. This identifier code 42 may, in one embodiment, be provided to the player with instructions to print the code, whereby the player then has a paper or other document with the code printed thereon for subsequent presentation at a redemption location, as discussed below. In an alternative embodiment, the identifier code 42 may be provided in electronic form, such as a QR code or bar code, to the player, wherein the player can store the code on their device 36 for subsequent presentation and scanning at a redemption location.

At step 134, the player takes the identifier code 42 to an authorized redemption location, which may be any one of the retailers 32 authorized by the gaming authority to sell the initial lottery tickets 10. For larger prize amounts, the player may be instructed to redeem the prize at a lottery authority redemption center.

At step 136, the retailer will scan or otherwise enter the identifier code 42 into the lottery host computer system 30 in order to access the set 28 of game result files 24 initially provided to the host computer system 30.

At step 138, the unique file identifier 26 contained in the identifier code 42 is used to retrieve the corresponding game result file 24 from the host computer system 30. This game result file is effectively identical to the game result file 24 initially assigned to the player by the game server system 20 at the time of accessing the game site and thus contains the predetermined outcome and prize value.

At step 140, a determination is made as to whether or not the actual game result file 24 is still maintained in the host computer system 30. If the file is not present, then this signifies that the game file was already used to redeem a prize award and was eliminated from the set 28 of files maintained by the host computer system 30. In this event, at step 142, the host computer system 30 generates a message informing the player that the prize award is declined. The player may also be informed (through the retailer or lottery official) as to the reasons why the award is declined.

If the game result file is present, then at step 144, the player is awarded the prize award associated with the respective game result file 24 and the game result file 24 is then effectively eliminated (e.g., deleted) from the set 28 of game result files maintained by the host computer system 30. By eliminating the redeemed game result files 24, the system ensures that multiple payouts are not awarded for the same game result files, as discussed above with respect to step 142 in FIG. 5B.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for implementing a network-based lottery game, comprising:

providing lottery tickets to players, by a lottery provider, wherein each of the lottery tickets includes a code that allows the player to access a game site maintained by an Internet server system for play of a lottery game via a network-enabled device;

distributing a separate and identical finite set of game result files, by the lottery provider, to a gaming authority computer system and separately to the Internet server system, wherein the gaming authority computer system and the Internet server system both individually maintain their respective finite set of game result files;

assigning to the player one of the game result files, by the Internet server system, from the finite set of game result files maintained by the Internet server system, wherein each game result file has a unique identifier and a predetermined game outcome, and wherein assignment of the game result file to the player from the set of game result files is randomly determined;

eliminating, by the Internet server system, the assigned game result file from the finite set of game result files maintained by the Internet server system, wherein the Internet server system eliminates the assigned game result file without communicating with the gaming authority host computer system;

displaying the predetermined game outcome to the player via the network-enabled device and, in the event of a winning game play, transmitting the unique identifier of the respective game result file to the player, by the Internet server system, for use in redeeming the game play;

providing, by the player, the unique identifier transmitted by the Internet server system to the gaming authority host computer independent from the Internet server system;

using the unique identifier to retrieve the corresponding game result file, by the gaming authority host computer, from the set of game result files maintained by the gaming authority host computer system to verify the player's redemption claim, wherein the gaming authority host computer system verifies the player's redemption claim without communicating with the Internet server system; and eliminating, by the gaming authority host computer, the retrieved game result file from the finite set of game result files maintained by the gaming authority host computer, wherein the gaming authority host computer system eliminates the retrieved game result file without communicating with the Internet server system.

2. The method as in claim 1, wherein the unique identifier for a winning game result file is transmitted to the player in the form of a code that is subsequently provided to the gaming authority host computer system by the player.

3. The method as in claim 2, wherein the code is provided for printing by the player and subsequent scanning or entry by a redemption device in communication with the gaming authority host computer system.

4. The method as in claim 2, wherein the code is provided in electronic form to the player for subsequent scanning by a redemption device in communication with the gaming authority host computer system.

5. The method as in claim 2, wherein the code is transmitted via a lottery terminal at a retail establishment authorized by the lottery provider to also sell the lottery game tickets, the lottery terminal configured to scan or otherwise enter the code presented by the player.

6. The method as in claim 1, wherein the lottery tickets are provided to players at retail establishments authorized by the lottery provider.

7. The method as in claim 6, wherein the lottery tickets also include an instant-win game component that may be played by the player independent of the network-based lottery game.

8. The method as in claim 1, wherein the set of game result files maintained by the Internet server system are randomly shuffled prior to assigning a first one of the game result files to a player.

9. The method as in claim 8, wherein the game result files are shuffled prior to every assignment of one of the game result files to a player.

10. The method as in claim 1, wherein the game result file assigned to the player is randomly selected from the set of game result files maintained by the server system.

11. The method as in claim 1, wherein the game result files include instruction files for implementing play of an interactive game by the player on their network-enabled device prior to results of the game play being presented to the player.

12. The method as in claim 11, wherein the instruction files are downloaded to the player's network-enabled device so that the player can play the interactive game in stages or repeat play of the interactive game without further communication with the Internet server system.

13. The method as in claim 1, wherein a record is maintained by the Internet server system of each code presented by a player for play of the-network-based lottery game, and the code presented by a player is checked against the record of previously presented codes to verify that the code has not been previously played.

14. The method as in claim 1, wherein a record is maintained by the Internet server system of all codes assigned to the lottery tickets, wherein the code presented by a player for play of the network-based lottery game is checked against the record of assigned codes to verify that the presented code is authentic.

15. A method for implementing an Internet-based lottery game, comprising:

establishing a finite set of game result files, via a lottery provider, with each game result file having a unique identifier and a predetermined game outcome;

distributing the finite set of game result files, via the lottery provider, to a gaming authority computer system and separately to an Internet server system, wherein the gaming authority computer system and the Internet server system both individually maintain their respective finite set of game result files, wherein the gaming authority computer system and the Internet server system are independent systems that operate without communicating with each other;

providing lottery tickets to players, via the gaming authority computer system, wherein each of the lottery tickets includes a code that allows the player to access an Internet game site maintained by the Internet server system via an Internet-enabled device for play of at least one lottery game on the Internet-enabled device;

assigning to the player one of the game result files, by the Internet server system, from the set of finite game result files maintained by the Internet server system;

eliminating, by the Internet server system, the assigned game result file from the finite set of game result files maintained by the Internet server system, wherein the Internet server system eliminates the assigned game result file without communicating with the gaming authority host computer system;

displaying the predetermined outcome of the game play to the player via the Internet server system, and, in the event of a winning game play, transmitting the unique identifier of the respective game result file to the player, by the Internet server system for use in redeeming the winning game play;

providing, by the player, the unique identifier transmitted by the Internet server system to the gaming authority host computer system independent from the Internet server system;

using the unique identifier presented by the player to retrieve the corresponding game result file, by the gaming authority host computer, from the set of game result files maintained by the gaming authority host computer system to verify the player's redemption claim, wherein the gaming authority host computer system verifies the player's redemption claim without communicating with the Internet server system; and eliminating, by the gaming authority host computer, the retrieved game result file from the finite set of game result files maintained by the gaming authority host computer, wherein the gaming authority host computer system eliminates the retrieved game result file without communicating with the Internet server system.

* * * * *